US008752347B2

(12) United States Patent
Keller

(10) Patent No.: US 8,752,347 B2
(45) Date of Patent: Jun. 17, 2014

(54) REINFORCEMENT ELEMENT FOR ABSORBING FORCES OF CONCRETE SLABS IN THE AREA OF SUPPORT ELEMENTS

(71) Applicant: F.J. Aschwanden AG, Lyss (CH)

(72) Inventor: Thomas Keller, Lully (CH)

(73) Assignee: F.J. Aschwanden AG, Lyss (CH)

( * ) Notice: Subject to any disclaimer, the term of this patent is extended or adjusted under 35 U.S.C. 154(b) by 0 days.

(21) Appl. No.: 14/093,584

(22) Filed: Dec. 2, 2013

(65) Prior Publication Data

US 2014/0102036 A1 Apr. 17, 2014

Related U.S. Application Data

(63) Continuation of application No. 12/753,862, filed on Apr. 3, 2010, now abandoned.

(30) Foreign Application Priority Data

Apr. 3, 2009 (EP) ..... 09157265

(51) Int. Cl.

| | |
|---|---|
| ***E04C 1/00*** | (2006.01) |
| ***E04C 5/06*** | (2006.01) |
| ***E04C 2/04*** | (2006.01) |
| ***E04B 5/43*** | (2006.01) |
| ***E04B 5/16*** | (2006.01) |

(52) U.S. Cl.

CPC ..... *E04C 5/0645* (2013.01); *E04C 5/06* (2013.01); *E04C 2/044* (2013.01); *E04B 5/43* (2013.01); *E04B 5/16* (2013.01)

USPC ..... 52/309.13

(58) Field of Classification Search

CPC ..... E04C 5/0645; E04C 5/064; E04C 5/01; E04C 5/02; E04C 5/06; E04C 2/044; E04B 5/43; E04B 5/16

USPC ..... 52/309.13, 309.17, 309.16, 251, 259, 52/319, 340, 341, 378, 379, 414, 649.1, 52/698, 703

See application file for complete search history.

(56) References Cited

U.S. PATENT DOCUMENTS 992,733 A * 5/1911 Conzelman ..... 52/259
1,008,606 A * 11/1911 Meier ..... 52/259

(Continued)

FOREIGN PATENT DOCUMENTS

EP 2236686 A1 * 10/2010 ..... E04B 5/43
JP 2010242494 A * 10/2010
JP 2012082680 A * 4/2012

*Primary Examiner* — Mark Wendell
*Assistant Examiner* — Keith Minter
(74) *Attorney, Agent, or Firm* — WRB-IP LLP

(57) ABSTRACT

A reinforcement element for absorbing forces of the concrete slabs to be supported in the area of support elements is formed from a longitudinally stable, flexible length element, its first end area being guided through a first flexural reinforcement layer of the concrete slab. The first area adjoining the first end area extends towards a second flexural reinforcement layer of the concrete slab at an acute angle α. The second area adjoining the first area is guided through the second flexural reinforcement layer and extends in the area of the support element along the surface of the second flexural reinforcement layer facing away from the support element. The second end area of the reinforcement element is guided through the second flexural reinforcement layer toward the first flexural reinforcement layer. This reinforcement element can be inserted into the concrete slab in many different ways according to the type of load.

15 Claims, 10 Drawing Sheets

(56) References Cited

U.S. PATENT DOCUMENTS

| | | | | |
|---|---|---|---|---|
| 1,031,047 | A * | 7/1912 | Conzelman | 52/259 |
| 1,035,323 | A * | 8/1912 | Cummings | 52/649.1 |
| 1,143,527 | A * | 6/1915 | Francis | 52/250 |
| 1,554,767 | A * | 9/1925 | Southern | 52/649.1 |
| 1,693,941 | A * | 12/1928 | Schuster | 52/261 |
| 1,794,425 | A * | 3/1931 | Sorensen | 52/231 |
| 1,804,132 | A * | 5/1931 | Tashjian | 52/334 |
| 1,812,690 | A * | 6/1931 | Frease | 52/231 |
| 3,283,458 | A * | 11/1966 | Gersovitz | 52/260 |
| 3,302,360 | A * | 2/1967 | Bjerking | 52/600 |
| 3,693,311 | A * | 9/1972 | Bjerking | 52/677 |
| 4,128,980 | A * | 12/1978 | Abdallah | 52/251 |
| 4,333,285 | A * | 6/1982 | Koizumi et al. | 52/252 |
| 5,079,890 | A * | 1/1992 | Kubik et al. | 52/649.1 |
| 5,181,359 | A * | 1/1993 | Chana et al. | 52/253 |
| 5,235,791 | A * | 8/1993 | Yaguchi | 52/649.1 |
| 5,248,122 | A * | 9/1993 | Graham | 249/91 |
| 5,763,043 | A * | 6/1998 | Porter et al. | 428/109 |
| 6,003,281 | A * | 12/1999 | Pilakoutas | 52/742.14 |
| 6,178,710 | B1 * | 1/2001 | Colalillo | 52/310 |
| 6,263,629 | B1 * | 7/2001 | Brown, Jr. | 52/309.16 |
| 6,293,063 | B2 * | 9/2001 | Van Doren | 52/251 |
| 6,385,930 | B1 * | 5/2002 | Broms et al. | 52/251 |
| 6,868,645 | B2 * | 3/2005 | Hauser | 52/742.14 |
| 7,143,554 | B2 * | 12/2006 | Sachs et al. | 52/251 |
| 2001/0010140 | A1 * | 8/2001 | Ritter et al. | 52/649.1 |
| 2003/0029111 | A1 * | 2/2003 | Yabuuchi et al. | 52/425 |
| 2003/0110724 | A1 * | 6/2003 | Haussler | 52/414 |
| 2003/0154674 | A1 * | 8/2003 | Matthaei et al. | 52/260 |
| 2003/0167715 | A1 * | 9/2003 | Messenger et al. | 52/309.12 |
| 2004/0050945 | A1 * | 3/2004 | Bernhardt | 237/69 |
| 2004/0074202 | A1 * | 4/2004 | Barmakian et al. | 52/745.19 |
| 2006/0059804 | A1 * | 3/2006 | Brown | 52/223.13 |
| 2006/0144000 | A1 * | 7/2006 | Patrick | 52/334 |
| 2007/0137133 | A1 * | 6/2007 | Bartels | 52/633 |
| 2008/0083181 | A1 * | 4/2008 | Ospina | 52/334 |
| 2008/0172974 | A1 * | 7/2008 | Suarez et al. | 52/685 |
| 2009/0094927 | A1 * | 4/2009 | Farrell, Jr. | 52/583.1 |
| 2010/0031605 | A1 * | 2/2010 | Hong et al. | 52/839 |
| 2010/0170194 | A1 * | 7/2010 | Leone | 52/838 |
| 2010/0205882 | A1 * | 8/2010 | Matiere | 52/259 |
| 2011/0083386 | A1 * | 4/2011 | Keller | 52/309.13 |
| 2011/0113714 | A1 * | 5/2011 | Hsu et al. | 52/434 |
| 2011/0185664 | A1 * | 8/2011 | Lee et al. | 52/309.16 |
| 2012/0066988 | A1 * | 3/2012 | Muttoni et al. | 52/223.14 |
| 2012/0090262 | A1 * | 4/2012 | Scola et al. | 52/676 |
| 2012/0137618 | A1 * | 6/2012 | Martter | 52/649.1 |
| 2012/0137619 | A1 * | 6/2012 | Martter | 52/649.1 |
| 2012/0167519 | A1 * | 7/2012 | Gunther | 52/677 |
| 2012/0177873 | A1 * | 7/2012 | Gunther | 428/114 |
| 2012/0205515 | A1 * | 8/2012 | Keller | 248/575 |
| 2012/0210656 | A1 * | 8/2012 | Martin Hernandez | 52/125.1 |
| 2012/0210669 | A1 * | 8/2012 | Lee | 52/649.2 |
| 2012/0240497 | A1 * | 9/2012 | O'Brien et al. | 52/223.6 |
| 2013/0104492 | A1 * | 5/2013 | Hung | 52/664 |
| 2013/0295340 | A1 * | 11/2013 | Trubnikow et al. | 428/179 |

* cited by examiner

REINFORCEMENT ELEMENT FOR ABSORBING FORCES OF CONCRETE SLABS IN THE AREA OF SUPPORT ELEMENTS

BACKGROUND AND SUMMARY

The present invention relates to a reinforcement element for absorbing forces of concrete slabs in the area of support elements, in particular supports and bearing walls, such slab being equipped with a first flexural reinforcement layer, located adjacent to the support element, and a second flexural reinforcement layer, facing away from the support element, wherein each flexural reinforcement layer is formed essentially by longitudinally and laterally extending reinforcing bars, a number of reinforcement elements being inserted between such flexural reinforcement layers.

Appropriate arrangements have to be made for concrete ceilings or foundation slabs that are supported by supports or on which supports are placed, in order to be able to introduce the supporting forces into the concrete ceilings or foundation slabs in an optimum manner. The shear and punching shear forces in particular must be absorbed, to which the concrete ceilings or foundation slabs are exposed.

For absorbing and introducing these forces into the concrete slabs in the area of the support elements, different solutions have been proposed. One of these proposed solutions, for example, is to insert reinforcement cages as reinforcement elements into the concrete slabs in the area of supports, with such reinforcement cages comprising several juxtaposed U-shaped stirrups that are interconnected by means of cross bars. These reinforcement cages were then inserted in the upper and lower flexural reinforcement layers of the concrete slab and connected to such layers.

These reinforcement cages take up quite a lot of space, storing them and transporting them to the construction site is therefore costly; in addition, loading for the corresponding concrete slabs is limited using such reinforcement cages.

Also known are so-called steel shearheads, which are used in areas of the concrete slabs to be supported. These steel shearheads meet the requirements regarding loading very well, but their disadvantage is that they are very expensive.

Also known are reinforcement elements formed out of reinforcing bars and that are equipped with a base bar with a bracket that is placed on the base bar and connected to it. These reinforcement elements, individually and in the required number, can be inserted into the area of the concrete slab to be supported between the upper and lower flexural reinforcement layer and is connected therewith. A good introduction of the forces into the concrete slab is achieved with these reinforcement elements; however, their handling is still relatively costly, as these reinforcement elements have to be pre-fabricated.

It is desirable to create a reinforcement element for absorbing the forces in concrete slabs in the area of support elements, which not only absorbs large loads but also can be manufactured simply and cheaply while its handling can be very flexible.

According to an aspect of the invention, each reinforcement element is formed out of a longitudinally stable, flexible length element, wherein its first end area is guided through the first flexural reinforcement layer, the first area of such stable, flexible length element that is adjoining the first end area proceeding at an acute angle $\alpha$ towards the second flexural reinforcement layer, the second area that is adjoining the first area being guided through the second flexural reinforcement layer and proceeding, in the area of the support element, along the surface of the second flexural reinforcement layer, which is facing away from the support element, and the second end area of such stable, flexible length element being guided through the second flexural reinforcement layer towards the first flexural reinforcement layer.

The longitudinally stable, flexible length element, through which the reinforcement elements are formed, can, for example, be brought to the construction site in a coil, the reinforcement elements can be uncoiled from this coil, and cut to the desired length; the required numbers of this longitudinally stable, flexible length element can then be easily laid between and through the first and second flexural reinforcement layer; the concrete slab that is reinforced in such a way can be supported in an optimum manner.

Advantageously, the longitudinally stable, flexible length element has the form of a band, wherein its width is a multiple of its thickness and which can be cut to the desired length. This length element can be inserted into the flexural reinforcement layers in an optimum manner. This band, of course, can be formed from a plurality of individual strands, which can be arranged next to each other and/or one on top of the other. This band can also be formed from one individual strand, which has loops at the end areas and is laid on top of itself in multiple layers.

Advantageously, several longitudinally and laterally extending reinforcement elements are each inserted into the concrete slab essentially parallel to the appropriate longitudinally and laterally extending reinforcing bars of the first flexural reinforcement layer and the second flexural reinforcement layer, wherein the number of the reinforcement elements depends on the loads to be absorbed and can be determined accordingly.

An additional advantageous embodiment of an aspect of the Invention is that the reinforcement elements are inserted into the concrete slab in multiple layers. Thus, the use of the reinforcement elements can be adapted in a very flexible way to the forces to be absorbed.

An additional advantageous embodiment of an aspect of the Invention is that the first and the second end areas and/or the first areas of the reinforcement elements, which are set in multilayers into the concrete slab, extending toward and away from one another, by which an optimum load distribution can be achieved, depending on the mode of application.

Advantageously, the angle $\alpha$ is in the range of 20° to 50°, enabling an optimum transfer of the forces to be absorbed.

An additional advantageous embodiment of an aspect of the invention is in that the longitudinally stable, flexible length element is formed out of carbon fibre reinforced plastics, by which the desired physical properties are achieved in an optimum manner.

An additional advantageous embodiment of an aspect of the invention is in that the second end area is guided into the first flexural reinforcement layer in accordance with the first end area for middle support elements for the concrete slab to be supported. By means of the symmetric arrangement, the forces are introduced optimally into the concrete slab.

The end areas of the reinforcement elements are each guided around at least one laterally extending reinforcing bar of the first flexural reinforcement layer, while the second area is guided across the appropriate laterally extending reinforcing bars of the second flexural reinforcement layer. This also results in an optimum introduction of the forces by means of the reinforcement elements to the flexural reinforcement layers.

An additional advantageous embodiment of an aspect of the invention is in that the edge supports of the slab can be supported, the second end area is guided against the support element to the first flexural reinforcement layer. The longitudinally stable, flexible length element forming the reinforcement element is suitable in an optimum way for any application.

The improvement of the anchoring of the end areas of the reinforcement elements in concrete slabs can be achieved in different ways: the end areas can be looped over several laterally extending reinforcing bars of the first flexural reinforcement layer; however, the end areas of the reinforcement elements can also be equipped with anchoring means serving as anchoring elements, adapted to the respective types of application.

Advantageously, saddle elements are fitted on the laterally extending reinforcing bars around which the reinforcement elements are diverted, with such saddle elements protecting the reinforcement elements in these areas.

An additional advantageous embodiment of an aspect of the invention is in that the reinforcement elements can be inserted in existing slabs in the area of support elements, for which drill holes can be applied to the slab to be reinforced, through which holes the respective reinforcement element can be inserted, and that the drill holes can be filled and the end areas can be held with anchoring elements. Existing constructions can thus also be reinforced in an optimum manner with the same reinforcement elements.

In this case as well, in the area of the redirections of the reinforcement elements, saddle elements can be inserted into the drill holes, the reinforcement elements are supported on such saddle elements, by which means the reinforcement elements are protected from damage here as well.

BRIEF DESCRIPTION OF THE DRAWINGS

Embodiments and types of application of the reinforcement elements according to the invention are described in more detail based on the enclosed drawing.

In the following.

DETAILED DESCRIPTION

Figure 1:
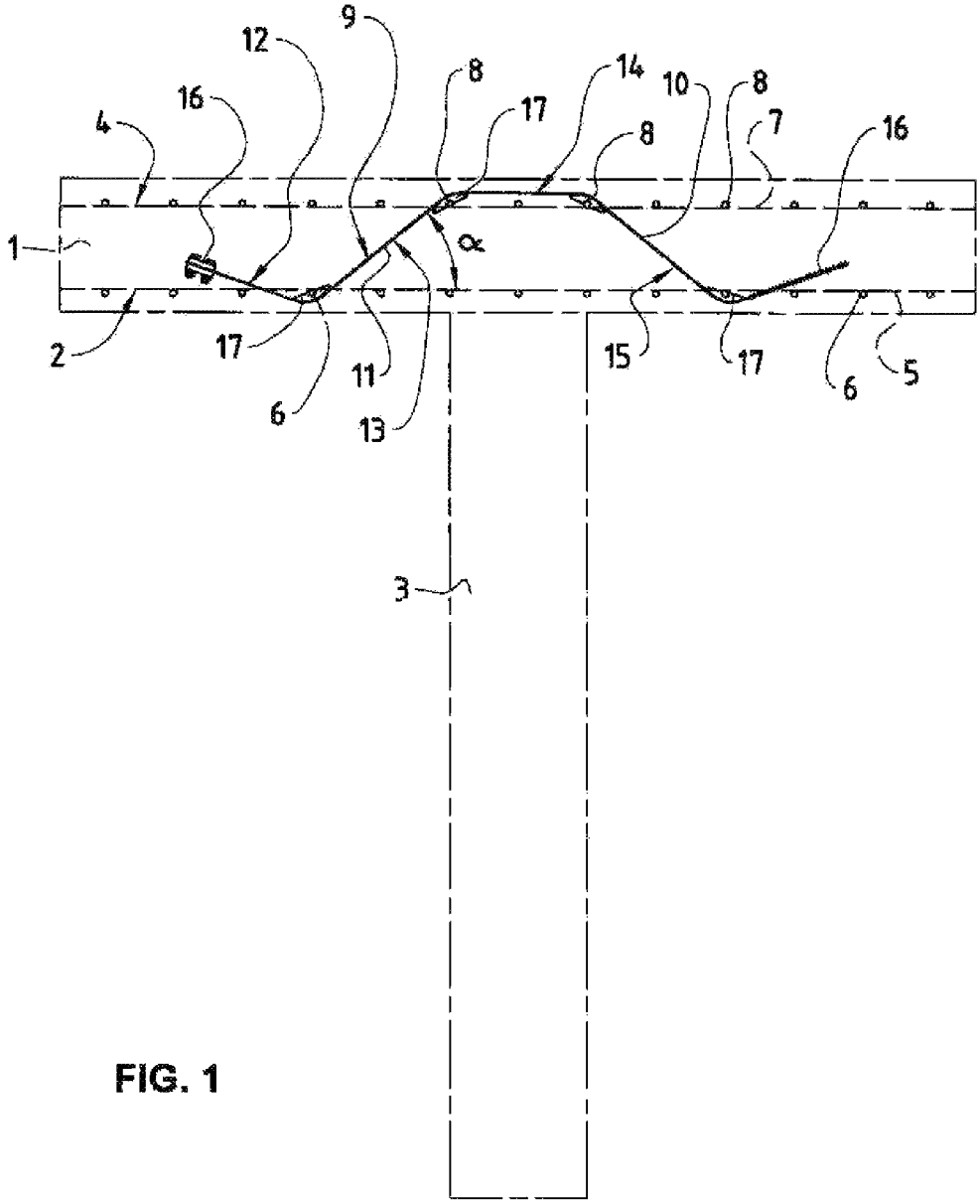
FIG. 1 shows a view of a schematically represented reinforcement element according to the invention, which is inserted in a concrete slab in the area of a support element.

FIG. 1 shows a concrete slab 1, which serves as a ceiling of a building, for example. This concrete slab comprises in a known manner a first flexural reinforcement layer 2, which is adjacent to the support elements 3 that are supporting the concrete slab 1, as well as a second flexural reinforcement layer 4, which is embedded in the concrete slab 1 on the side facing away from the support elements 3. The first flexural reinforcement layer 2 is formed in a known manner by longitudinally extending reinforcing bars 5 and laterally extending reinforcing bars 6; the second flexural reinforcement layer 4 also comprises longitudinally extending reinforcing bars 7 and laterally extending reinforcing bars 8 in a known manner. A reinforcement element 9 according to the invention is inserted in the area of the support element 3 shown here. This reinforcement element 9 is formed from a longitudinally stable, flexible length element 10 having a high tensile strength and axial rigidity, but such longitudinally stable, flexible length element is flexible in the direction that is perpendicular to the longitudinal direction. This longitudinally stable, flexible length element 10 is shown in the embodiment example represented here as a band 11, wherein its width is a multiple of the thickness. This band comprises, for example, a carbon fibre reinforced plastic. Of course, other appropriate materials are conceivable, particularly if they have a high tensile strength and axial rigidity. Of course, forms other than that of a band can be used; a bundle of thinner, longitudinally stable, flexible elements having the desired properties would be conceivable as well.

The reinforcement element 9 has a first end area 12 that is guided through the first flexural reinforcement layer 2. Here, the first end area 12 loops around a laterally extending reinforcing bar 6 of the first flexural reinforcement layer 2; the adjoining first area 13 leads away from this laterally extending reinforcing bar 6 at an angle $\alpha$, which is in the range of 20° to 50°, and reaches the second flexural reinforcement layer 4. In so doing, the first area 13 loops around a laterally extending reinforcing bar 8 of the second flexural reinforcement and ends at the second area 14. This second area 14 extends essentially across the width of support element 3 above the second flexural reinforcement layer 4; it is then looped around a further laterally extending reinforcing bar 8 and ends at a second end area 15, which is guided towards the first flexural reinforcement layer 2. In the example shown here, reinforcement element 9 is symmetrically guided through the concrete slab 1 relative to the support element 3; such an arrangement is carried out if the support element 3 has to support a concrete slab 1, which extends past this support element 3 on both sides. Such a reinforcement element 9 can be inserted very easily into the first flexural reinforcement layer 2 and the second flexural reinforcement layer 4 prior to pouring the concrete slab; such a band 11 can, for example, be brought to the construction site in the form of a rolled-up coil; a portion of this band is uncoiled and cut to the desired length; the reinforcement element that is inserted into the first flexural reinforcement layer 2 and the second flexural reinforcement layer 4 can be fixed; in addition, the ends of the end areas 12 and 15 can be equipped with anchoring means 16, as described in detail below. In order to avoid damage to the band in the area of the loop around the reinforcing bars, saddle elements 17 can be fitted in a known manner to these reinforcing bars, with such saddle elements being formed from plastics, for example.

After inserting these reinforcement elements 9, the concrete can be poured. In the cured state of the concrete, the support forces are absorbed by these reinforcement elements 9 in an optimum manner; in particular, these forces are dispersed optimally over a large area to the first flexural reinforcement layer as well, wherein these reinforcement elements are practically only subject to tension.

Figure 2:
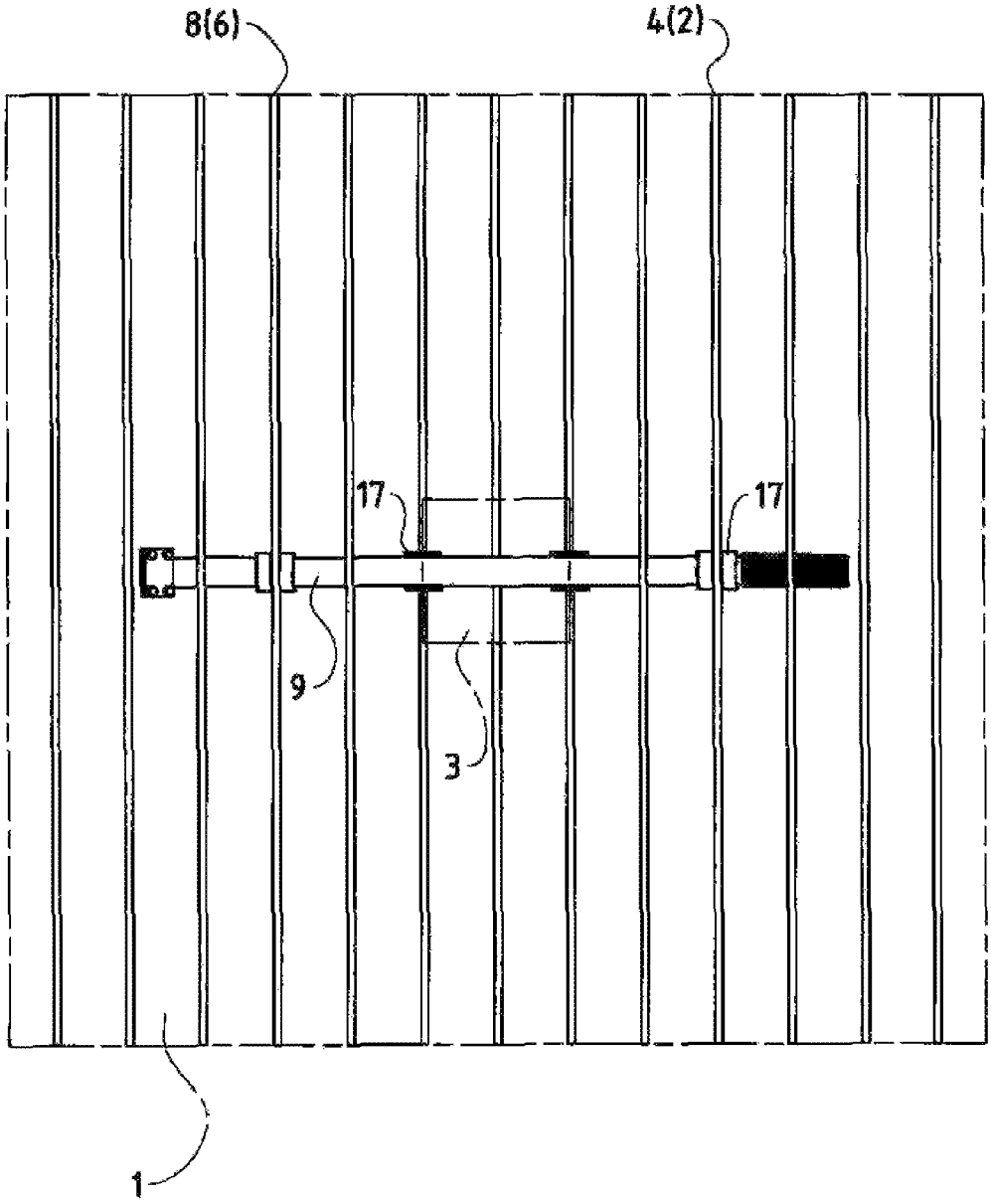
FIG. 2 shows a top view of the reinforcement element according to the invention, in accordance with FIG. 1.

FIG. 2 shows a view of the concrete slab 1 (represented by a dot-dash line), the support element 3 supporting concrete slab 1, the first and second flexural reinforcement layers 2 and 4 that are inserted into the concrete slab, wherein of these, only the laterally extending reinforcement bars 6 and 8 are shown for the sake of clarity, while the longitudinally extending reinforcing bars have been left out for the sake of clarity. As described above, the reinforcement element 9 is inserted in the first flexural reinforcement layer 2 and in the second flexural reinforcement layer 4, wherein such reinforcement element is protected by and guided across saddle elements 17 that are fitted to the reinforcing bars.

Figure 3:
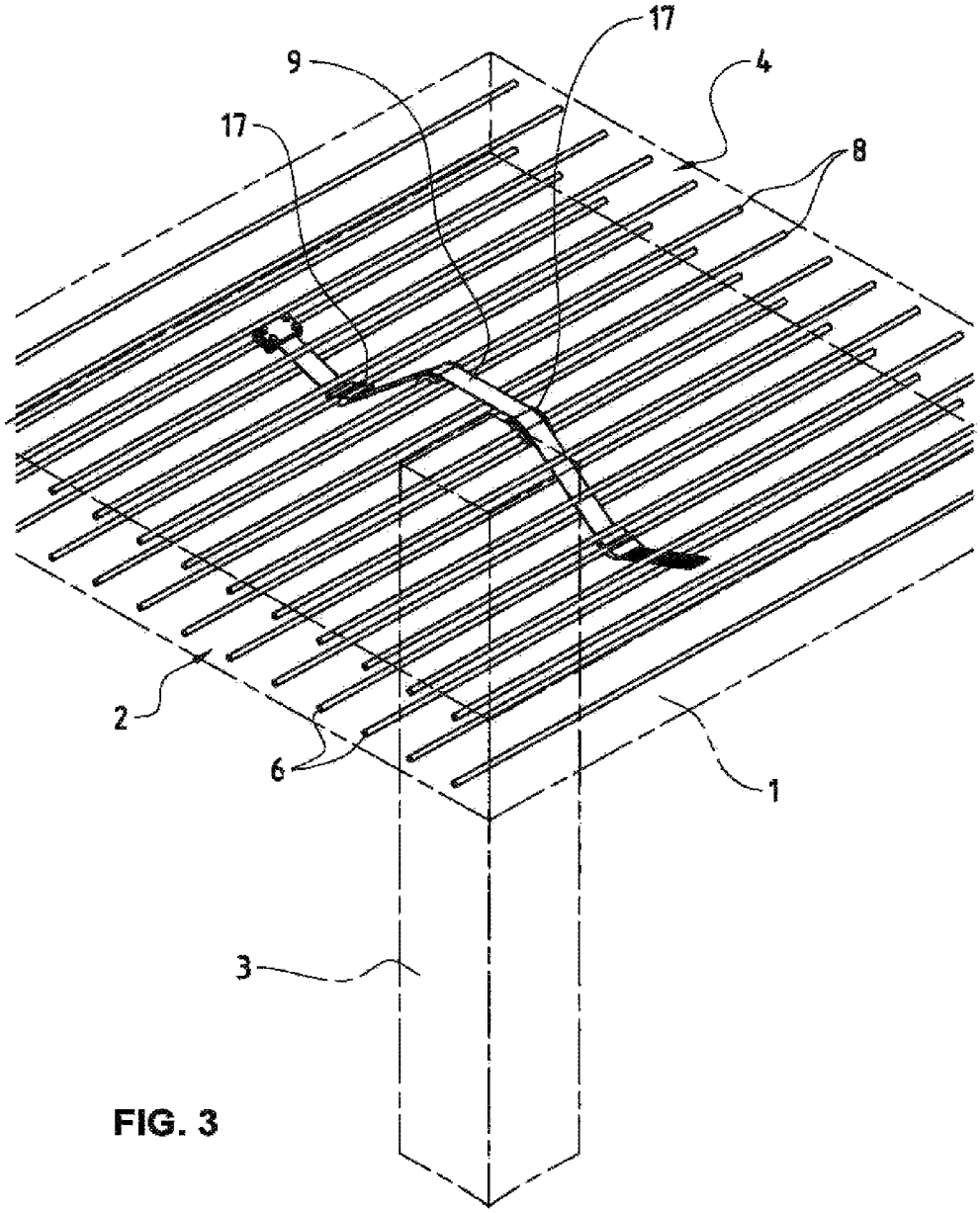
FIG. 3 shows a three-dimensional representation of the reinforcement element according to the invention, in accordance with FIGS. 1 and 2.

FIG. 3 shows a three-dimensional representation of this embodiment.

Figure 4:
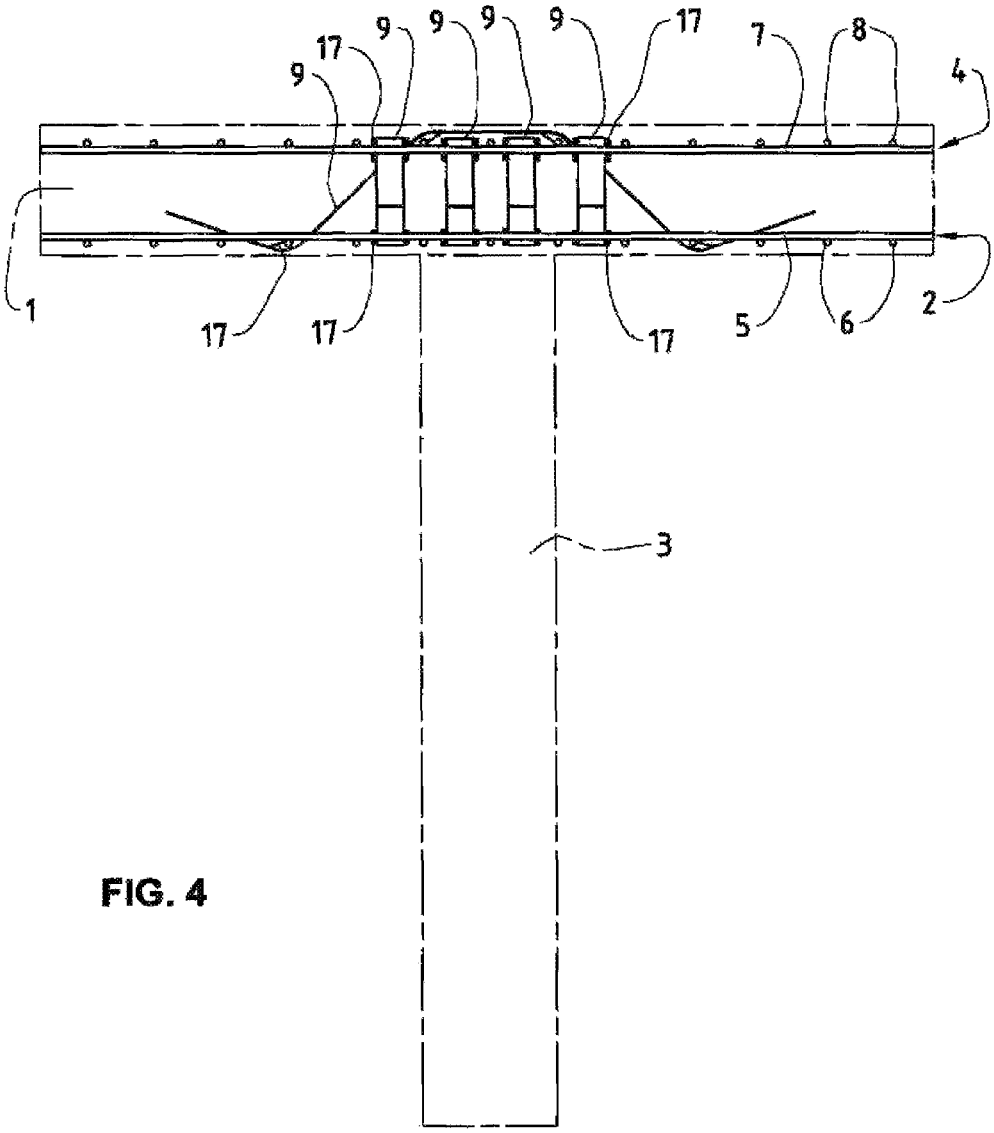
FIG. 4 shows a view of several reinforcement elements according to the invention, which are inserted in the schematically represented concrete slab in the area of a support element.
Figure 5:
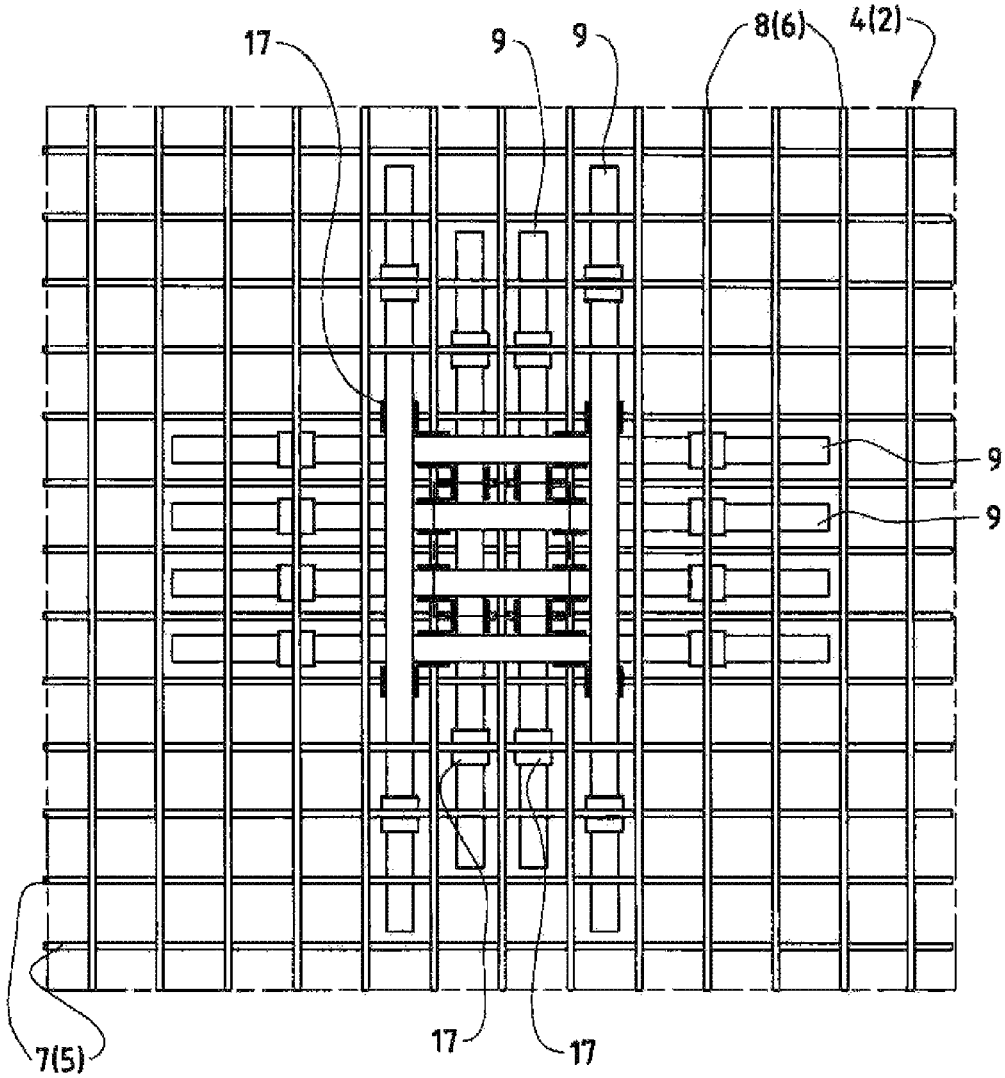
FIG. 5 shows a top view of the arrangement of the reinforcement elements according to the invention, in accordance with FIG. 4.
Figure 6:
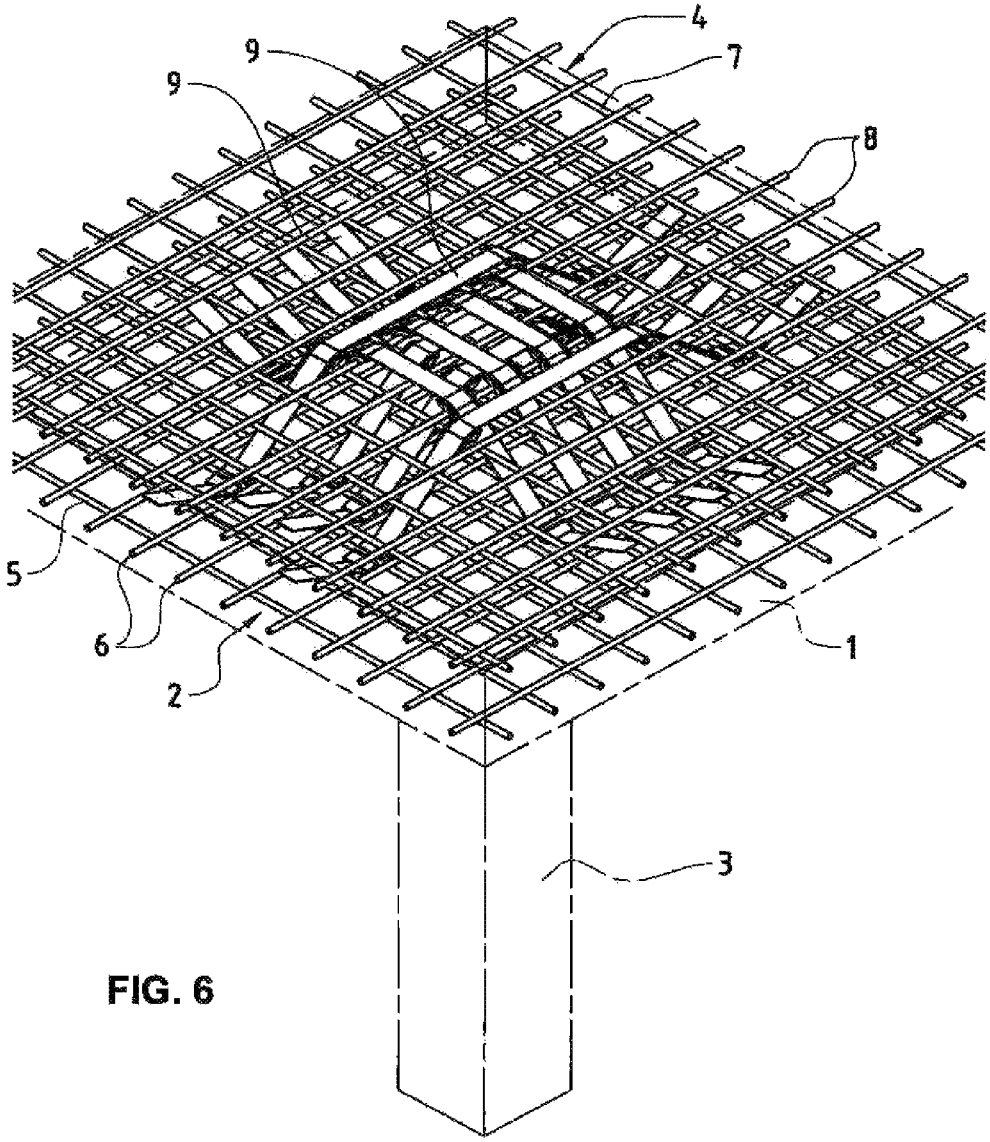
FIG. 6 shows a three-dimensional representation of the arrangement of the reinforcement elements according to the invention in the concrete slab, according to FIGS. 4 and 5.

FIGS. 4 to 6 show the arrangement of several reinforcement elements 9 in a concrete slab 1 in the area of a support element 3, by which the concrete slab is supported. The concrete slab is equipped with the first flexural reinforcement layer 2 and the second flexural reinforcement layer 4, as described above. The first flexural reinforcement layer 2 is formed by longitudinally extending reinforcing bars 5 and laterally extending reinforcing bars 6; the second flexural reinforcement layer 4 comprises longitudinally extending reinforcing bars 7 and laterally extending reinforcing bars 8. In the embodiment example shown here, four reinforcement elements 9 are laid across the laterally extending reinforcing bars 6 or 8 of the first flexural reinforcement layer 2 and the second flexural reinforcement layer 4, and accordingly extend parallel to the longitudinally extending reinforcing bars 5 or 7. Four reinforcement elements 9 are laid across the longitudinally extending reinforcing bars 5 of the first flexural reinforcement layer 2 and across the longitudinally extending reinforcing bars 7 of the second flexural reinforcement layer 4, and therefore extend parallel to the laterally extending reinforcing bars 6 or 8. Saddle elements 17 are fitted to the reinforcing bars 5 to 8, across which the reinforcement elements 9 are diverted around the reinforcing bars 5 to 8.

Depending on the dimensions of support 3 and the design of the first flexural reinforcement layer 2 and of the second flexural reinforcement layer 4, more or fewer reinforcement elements 9 can be used, depending on the loads to be absorbed.

Figure 7:
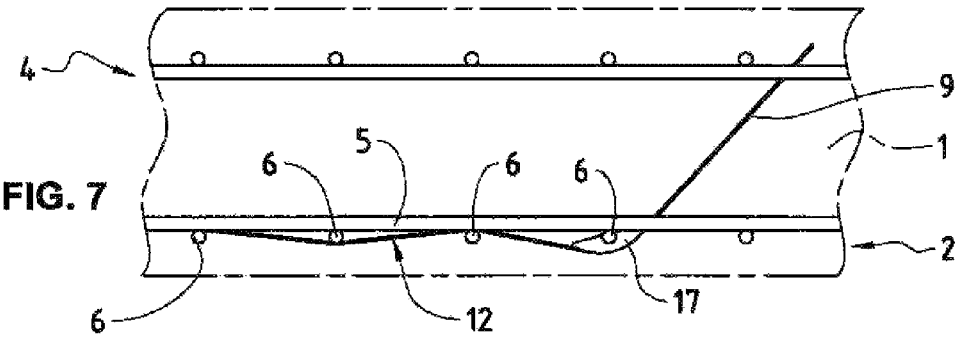
FIG. 7 shows a view of a first end area of a reinforcement element according to the invention, which is looped around the reinforcing bars.

FIG. 7 shows an embodiment example of how the first end area 12 of a reinforcement element 9 can be anchored in the first flexural reinforcement layer 2. This first end area 12 can be woven around a number of laterally extending reinforcing bars 6 of the first flexural reinforcement layer 2, as shown in FIG. 7. Thus, after the concrete is poured, the first end area 12 of the reinforcement element 9 is held in the first flexural reinforcement layer 2.

Figure 8:
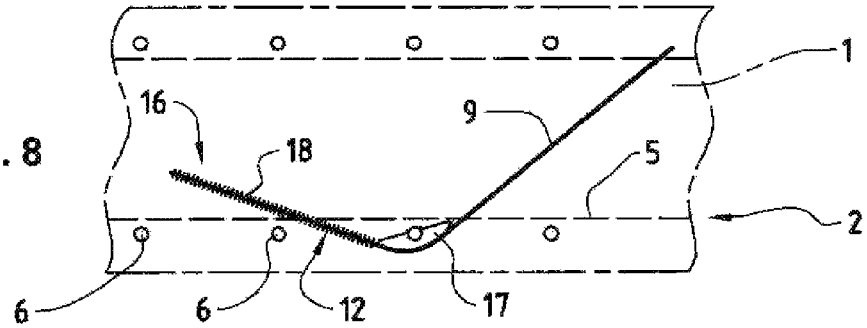
FIG. 8 shows a view of the first end area of a reinforcement element according to the invention, which is equipped with adhesive layers.

FIG. 8 shows a first end area 12 of a reinforcement element 9, which is equipped on both sides with an adhesive layer 18 in a known manner, such adhesive layer serving as anchoring means 16.

Figure 9:
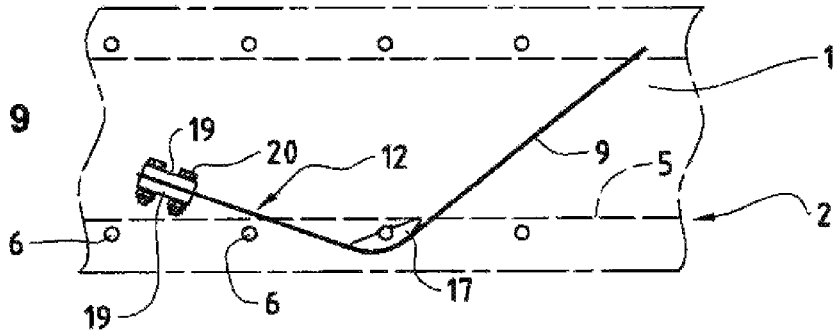
FIG. 9 shows a view of the first end area of a reinforcement element according to the invention, which is equipped with an anchoring part.

FIG. 9 shows the first end area 12 of a reinforcement element 9, provided with plates 19 attached to both sides as anchoring means 16, which are held by screw means 20 at the first end area 12 of the reinforcement element 9.

Figure 10:
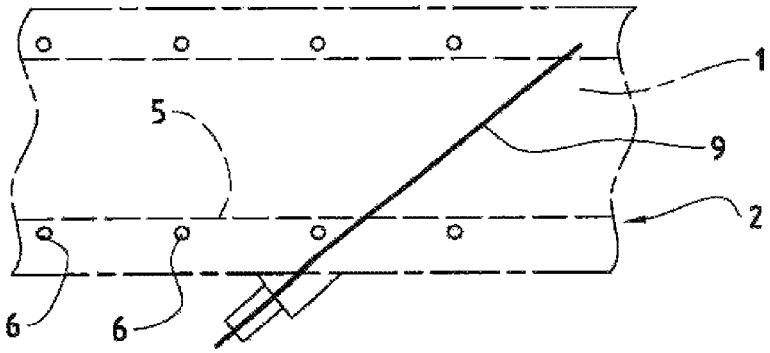
FIG. 10 shows a view of the first end area of a reinforcement element according to the invention, which is anchored externally to the concrete slab.

As evident from FIG. 10, it is also conceivable to anchor the reinforcement element 9 outside of the concrete slab 1 in a known manner.

Figure 11:
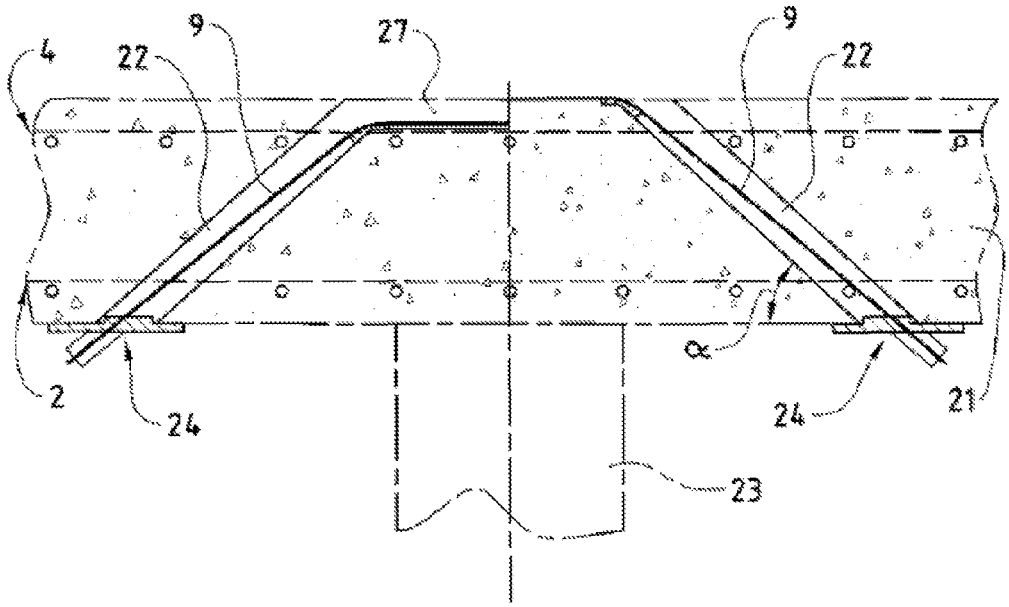
FIG. 11 shows a view of reinforcement elements according to the invention, which were subsequently inserted into an already existing structure.

As evident from FIG. 11, reinforcement elements 9 according to the invention can also be inserted into existing structures. The slab 21 to be reinforced can be provided with drill holes 22, extending at an acute angle $\alpha$ (in the range of 20° to 50°) toward the side of the slab that is facing away from support 23 and exiting slab 21 approximately in the area of support 23. The reinforcement element 9 can then be inserted in these drill holes 22; with such reinforcement element 9 can be anchored in a known manner using anchoring means 24 at the surface of slab 21 that is facing support 23. It is of course conceivable that this reinforcement element 9 be pre-tensioned in a known manner.

The left side of FIG. 11 shows an embodiment in which the reinforcement element 9 is inserted in a recess 27, e.g. a milled slot, on the side of slab 21 facing away from support 23, while the right side of FIG. 11 shows an embodiment in which the reinforcement element is resting on the surface of slab 21 that is facing away from support 23.

After inserting and optionally pre-tensioning the reinforcement element 9 in the drill holes 22 and if applicable in the recess 27 of slab 21, the drill holes 22 and if applicable the recess 27 can be poured in a known manner.

An optimum reinforcement of an existing structure is achieved by this design. Depending on the loads to be absorbed, multiple reinforcement elements 9 can be inserted in slab 21 in the area of support 23; it is also conceivable to place those reinforcement elements 9 crosswise, in accordance with the embodiments according to FIGS. 4 to 6.

Figure 12:
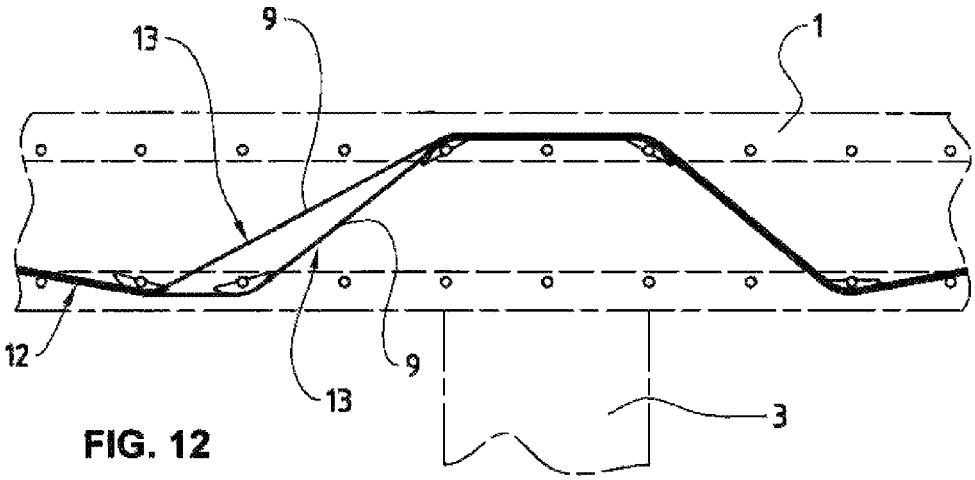
FIG. 12 shows a view of reinforcement elements according to the invention, which are arranged one on top of the other in a multilayer.

FIG. 12 shows an embodiment in which two reinforcement elements 9 are laid on top of each other and inserted into concrete slab 1. These two reinforcement elements 9, which are laid on top of each other, can be inserted so that they are extending parallel, as shown on the right side of FIG. 12; however, they can also be inserted, particularly in the first area 13 of the reinforcement elements 9, so that they extend away from each other, as shown on the left side of FIG. 12. The first end areas 12 also do not have to be parallel; they can be arranged so that they extend away from each other as well.

Of course, a larger number of reinforcement elements 9 can be layered on top of each other, depending on the forces to be absorbed. Several adjacent reinforcement elements can also be executed in multilayers; the choices are practically unlimited.

Figure 13:
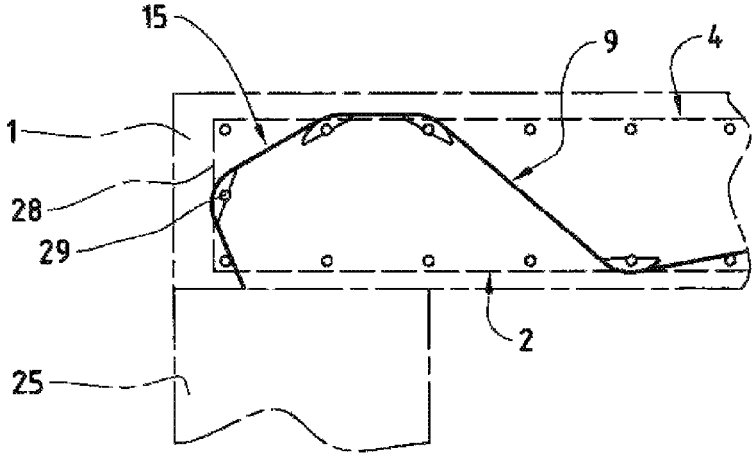
FIG. 13 shows a view of a first end area of a reinforcement element according to the invention in the area of a laterally supported concrete slab.

The embodiment examples described above describe reinforcement elements 9 and how they are used in the area of support elements 3, which are arranged in the middle part of a concrete slab to be supported. As seen from FIG. 13, these reinforcement elements 9 can also be used in edge support elements 25, which are supposed to support an edge area of a concrete slab 1. These edge support elements 25 can be individual supports but can also be a support wall. The concrete slab 1 is again provided with a first flexural reinforcement layer 2 and a second flexural reinforcement layer 4, which are connected in the edge area by means of flexural reinforcement bars 28. As described above, the reinforcement element 9 is inserted in the first flexural reinforcement layer 2 and the second flexural reinforcement layer 4 on the slab proceeding from support element 25. The second end area 15 of the reinforcement element 9 is guided towards the first flexural reinforcement layer 2 by the second flexural reinforcement layer 4; with such second end area 15 can be laid around an intermediate bar 29 that is inserted between the first flexural reinforcement layer 2 and the second flexural reinforcement layer 4. The end of the second end area 15 of the reinforcement area 9 can be equipped with anchoring means in a known manner, as described above.

Figure 14:
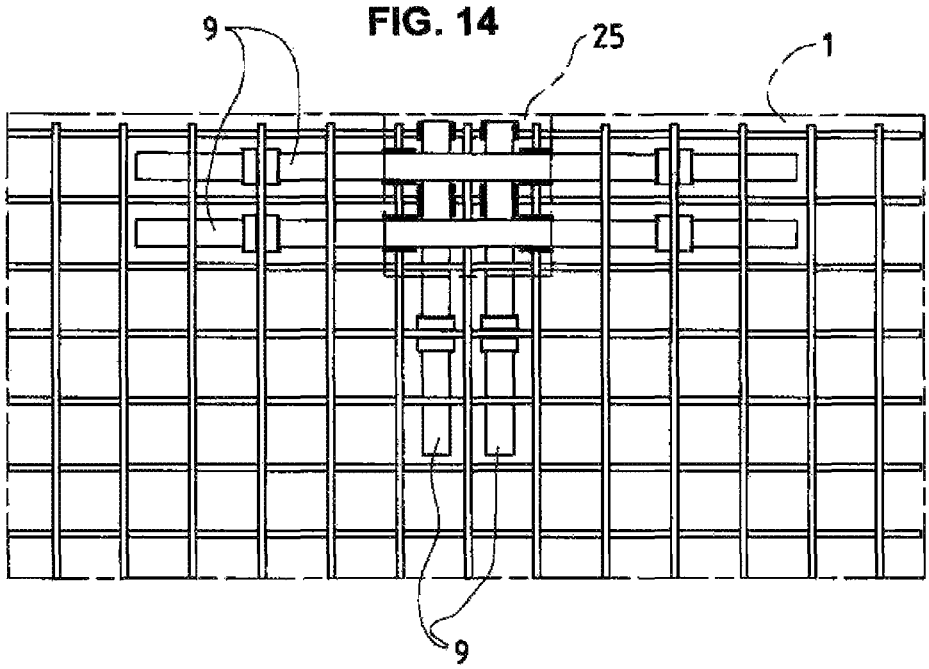
FIG. 14 shows a top view of an arrangement of reinforcement elements according to the invention, in a concrete slab in the area of an edge support.

FIG. 14 shows a possibility for equipping the concrete slab 1 in the area of an edge support element with appropriate reinforcement elements 9. The reinforcement elements 9, running parallel to the edge of concrete slab 1, are inserted into concrete slab 1 in such a way as is described in FIGS. 1 to 12. The reinforcement elements 9, running at right angles to the edge of concrete slab 1, are inserted into concrete slab 1 in such a way as is described in FIG. 13. If the edge support element 25 is formed as a support wall, the reinforcement elements 9 can be inserted adjacently along such support wall in such a way as is described in FIG. 13.

Figure 15:
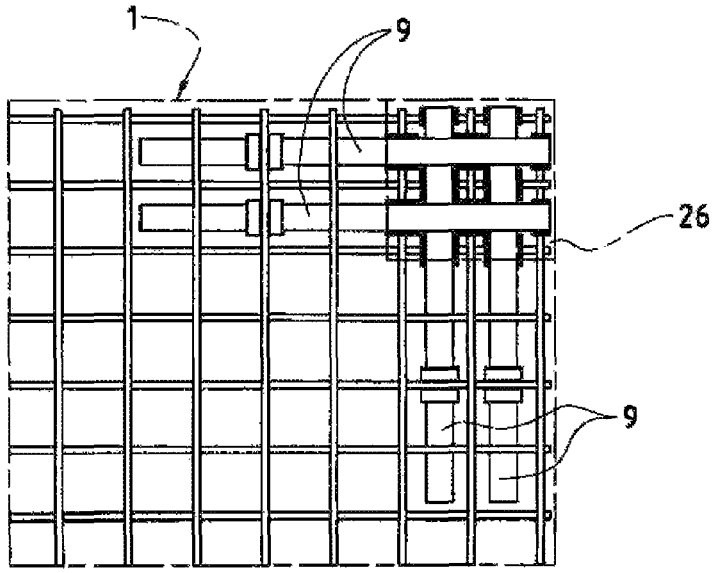
FIG. 15 shows a view of reinforcement elements according to the invention, which are arranged in the area of a corner support for a concrete slab.

FIG. 15 shows a concrete slab, in which a corner support element 26 is arranged in its corner. Reinforcement elements 9 can be inserted in such a way as is described in FIG. 13 for reinforcing this corner area of the slab 1 to be supported; these reinforcement elements 9 can also be arranged crosswise in this case.

Concrete slabs to be supported can be optimally reinforced in the area of support elements using these reinforcement elements according to the invention. These reinforcement elements can be used very easily; the plurality of possible applications permits the use of an optimum number of such reinforcement elements, depending on the loading case; the band-like design enables a multilayer use of these reinforcement elements, they can also be arranged next to each other and crosswise in any desired manner.

The invention claimed is:

1. A method of providing reinforcement for a concrete slab by a support element for the slab, comprising:

providing a first, substantially planar, flexural reinforcement layer formed by longitudinally and laterally extending reinforcing bars adjacent to the support element;

providing a second, substantially planar, flexural reinforcement layer formed by longitudinally and laterally extending reinforcing bars facing away from the support element;

after providing the first and second flexural reinforcement layers adjacent to and facing away from the support element, respectively, inserting, one or more reinforcement elements, each reinforcement element comprising a longitudinally stable, flexible length element, between the first and second flexural reinforcement layers, the inserting of one or more reinforcement elements between the first and second flexural reinforcement layers comprising, for at least one reinforcement element of the one or more reinforcement elements extending a first end area of the reinforcement element along the first flexural reinforcement layer, bending the reinforcement element around a reinforcing bar in the first flexural reinforcement layer so that a first area of the reinforcement element extends toward the second flexural reinforcement layer and the first area defines an acute angle with the first flexural reinforcement layer, the acute angle being any of a non-zero range of acute angles, and bending the reinforcement element, around a reinforcing bar in the second flexural reinforcement layer so that a second area of the reinforcement element extends along a surface of the second flexural reinforcement layer in an area of and facing away from the support element and so that the second area defines an angle with the first area, and bending the reinforcement element around another reinforcing bar in the second flexural reinforcement area so that a further portion of the reinforcement element extends toward the first flexural reinforcement layer.

2. The method as set forth in claim 1, wherein the step of inserting one or more reinforcement elements comprises bending the reinforcement element around another reinforcing bar in the first flexural reinforcement area so that a second end area of the reinforcement element extends along the first flexural reinforcement layer and defines an acute angle with the further portion of the reinforcement element.

3. The method as set forth in claim 2, wherein the first end area and the second en area of at least one reinforcement element of the one or more reinforcement elements extend away from each other.

4. The method as set forth in claim 2, wherein the first end area and the second end area of at least one reinforcement element of the one or more reinforcement elements extend toward each other.

5. The method as set forth in claim 2, wherein the step of inserting the one or more reinforcement elements comprises guiding the second end area toward the first flexural reinforcement layer.

6. The method as set forth in claim 5, comprising guiding the second end area toward the first flexural reinforcement layer by bending the reinforcement element around an intermediate bar between the first and second flexural reinforcement layers.

7. The method as set forth in claim 1, comprising looping the first end area of the reinforcement element across multiple laterally extending reinforcing bars of the first flexural reinforcement layer.

8. The method as set forth in claim 1, comprising providing anchoring means at the first end area of the at least one reinforcement element.

9. The method as set forth in claim 1, comprising providing saddle elements on laterally extending reinforcing bars of the first and second flexural reinforcement layers around which the at least one reinforcement element is bent so that the at least one reinforcement element is supported on the saddle elements.

10. The method as set forth in claim 1, comprising the step of inserting the one or more reinforcement elements comprises inserting the at least one reinforcement element in an existing concrete slab and includes drilling holes in the concrete slab to be reinforced, inserting the at least one reinforcement element through the drill holes.

11. The method as set forth in claim 10, comprising filling the drill holes with concrete.

12. The method as set forth in claim 10, comprising attaching an anchoring element at the first end area.

13. The method as set forth in claim 10, comprising inserting one or more saddle elements into the drill holes in locations where the reinforcement element is bent around the reinforcing bars in the first and second flexural reinforcement layers.

14. The method as set forth in claim 1, comprising inserting a plurality of longitudinally and laterally extending reinforcement elements between the first and second flexural reinforcement layers.

15. The method as set forth in claim 1, comprising forming a concrete slab after inserting the one or more reinforcement elements between the first and second flexural reinforcement layers.

* * * * *